US006884035B2

(12) United States Patent
Young

(10) Patent No.: US 6,884,035 B2
(45) Date of Patent: Apr. 26, 2005

(54) FAN BLADE ATTACHMENT

(75) Inventor: Stanfield Young, Cypress, CA (US)

(73) Assignee: Minka Lighting, Inc., Corona, CA (US)

( * ) Notice: Subject to any disclaimer, the term of this patent is extended or adjusted under 35 U.S.C. 154(b) by 151 days.

(21) Appl. No.: 10/196,481

(22) Filed: Jul. 15, 2002

(65) Prior Publication Data

US 2004/0009064 A1 Jan. 15, 2004

(51) Int. Cl.[7] ..... F04D 29/34

(52) U.S. Cl. ..... 416/5; 416/210 R; 416/219 A; 416/220 A; 416/244 R; 416/194; 29/889.21; 29/889.3

(58) Field of Search ..... 416/5, 204 R, 416/210 R, 211, 219 A, 220 A, 244 R, 194, 195; 29/456, 525.02, 889.21, 889.3; D23/377, 379, 411, 413, 385

(56) References Cited

U.S. PATENT DOCUMENTS

| | | | | | |
|---|---|---|---|---|---|
| 642,234 | A | * | 1/1900 | Kenyon | 416/195 |
| 1,000,528 | A | * | 8/1911 | Lockwood | 416/194 |
| 1,381,819 | A | * | 6/1921 | Garfield | 416/210 R |
| 1,501,201 | A | * | 7/1924 | Cates | 416/194 |
| 2,237,039 | A | | 4/1941 | Newnham | |
| 3,942,839 | A | * | 3/1976 | Chalk | 416/194 |
| 5,330,323 | A | * | 7/1994 | Swanson | 416/219 A |
| 5,421,701 | A | | 6/1995 | Funston | |
| 5,433,585 | A | | 7/1995 | Yan | |
| 5,462,412 | A | | 10/1995 | Scofield et al. | |
| D372,080 | S | * | 7/1996 | Dolan | D23/411 |
| D394,103 | S | * | 5/1998 | Lee | D23/411 |
| 5,951,253 | A | | 9/1999 | Gajewski | |
| D417,494 | S | * | 12/1999 | Evans | D23/377 |
| 6,059,531 | A | * | 5/2000 | Tai | 416/220 A |
| 6,158,964 | A | | 12/2000 | Gajewski | |
| 6,176,680 | B1 | * | 1/2001 | Ringblom et al. | 416/220 A |
| 6,250,885 | B1 | | 6/2001 | Gajewski | |
| 6,261,064 | B1 | | 7/2001 | Tang | |
| D448,840 | S | | 10/2001 | Gajewski | |
| 6,336,792 | B1 | | 1/2002 | Bucher et al. | |
| 6,354,801 | B1 | | 3/2002 | Gajewski | |
| 6,357,714 | B1 | | 3/2002 | Johnson | |
| 6,364,617 | B1 | | 4/2002 | Riske et al. | |
| 6,364,638 | B1 | | 4/2002 | Liu | |
| 6,371,729 | B1 | | 4/2002 | Tseng | |
| D466,206 | S | * | 11/2002 | Gajewski | D23/377 |
| D475,782 | S | * | 6/2003 | Hidalgo | D23/411 |
| D476,408 | S | * | 6/2003 | Hidalgo | D23/411 |
| D478,654 | S | * | 8/2003 | Hidalgo | D23/413 |
| D478,974 | S | * | 8/2003 | Hidalgo | D23/377 |
| D478,980 | S | * | 8/2003 | Hidalgo | D23/411 |
| D480,796 | S | * | 10/2003 | Young | D23/411 |
| D481,450 | S | * | 10/2003 | Young | D23/377 |
| D481,454 | S | * | 10/2003 | Young | D23/411 |
| D482,773 | S | * | 11/2003 | Young | D23/411 |
| 2003/0219340 | A1 | * | 11/2003 | Hidalgo | 416/5 |

OTHER PUBLICATIONS

Minka Lighting, Inc.; MinkaAire Two Thousand Two; Apr. 22, 2002; pp. 2, 3; Minka Lighting, Inc.; U.S.A.

Minka Lighting, Inc.; MinkaAire; 1997 (estimated date of publication); pp. 6, 7; Minka Lighting, Inc.; U.S.A.

Minka Lighting, Inc.; MinkaAire Two Thousand One; Oct. 5, 2000; pp. 8, 9; Minka Lighting, Inc.; U.S.A.

Minka Lighting, Inc.; MinkaAire Two ThousandTwo; Apr. 22, 2002; pp. 14, 15; Minka Lighting, Inc.; U.S.A.

* cited by examiner

*Primary Examiner*—Christopher Verdier
(74) *Attorney, Agent, or Firm*—Baker & McKenzie LLP

(57) ABSTRACT

A ceiling fan comprising a plurality of fan blades, each positioned in a slot of a corresponding bracket attached to a rotatable hub. For each fan blade, a brace connects a mid-section of the fan blade to the corresponding bracket. The brace and bracket increase the support base of the fan blade. The fan blade is also, thereby, supported distal of its proximal end, thus reducing stresses at the fan blade proximal end. The fan blade may be positioned at relatively larger angles-of-attack without increasing the likelihood the fan blade will break.

25 Claims, 6 Drawing Sheets

FAN BLADE ATTACHMENT

FIELD OF THE INVENTION

The field of the present invention relates to fans, and in particular ceiling fans.

BACKGROUND OF THE INVENTION

A typical ceiling fan will include a downrod assembly suspended from the ceiling with a motor shaft connected to a lower portion of the downrod assembly. A motor body rotates about the motor shaft. A motor housing surrounding the motor may be secured to either the motor shaft or the downrod assembly, which is stationary. Blade mounting arms are connected to the motor body and extend out of an opening of the motor housing or below the motor housing. The fan blades are thus mounted as cantilevers extending from the hub. They have support bases typically no greater in area than the thickness of the blade times the width of the blade. Additional details concerning fans may be found in U.S. Pat. Nos. 6,250,885 and 6,354,801, issued to Gajewski and commonly assigned with this invention, which are incorporated herein by reference in their entirety.

In ceiling fan applications, the fan blades are relatively long to better circulate the air without creating concentrated drafts of air. The air resistance against the fan blade creates reactive moments at the proximal end of the fan blade, the end closest to the mounting rod. These reactive moments create stress in the fan blade that often leads to breakage. Additionally, ceiling fans are often run in both directions, e.g., both a winter mode for directing air upward and a summer mode for directing air downward. Running the fan in alternating directions can over time fatigue the fan blade. Such fatigue can also lead to breakage. To minimize effects of wind resistance, ceiling fan blades are typically set at relatively small angles-of-attack, relative to the direction of blade rotation.

Using small angles-of-attack, however, reduces the amount of air circulated when the blades are rotated. To compensate for reduced air circulation, the fans are often operated at higher speeds by an operator. Operating the fans consistently at high speeds can lead to a shorter motor life. High speed operation is also generally noisier, and hence more disturbing, than operating the fan at a relatively slower speed. Another problem often encountered with high speed operation is wobble and nutation of the fan hub due to, for example, an imbalanced rotor. Accordingly, it is desirable to generate an equal, or increased, amount of air circulation at reduced operating speeds. It is also desirable to reduce fan blade fatigue and breakage.

OBJECTS OF THE INVENTION

An object of the invention is to provide a fan blade with increased stability relative to conventional hub-supported fan blades.

A further object is to provide a fan blade assembly that is easily connectable to a fan hub.

Another objective of the invention is, for some applications, to provide increased fan blade support without significantly affecting drag due to wind resistance against the fan blade support.

Another object is to provide a fan blade kit that is simple to assemble.

Another object is to reduce stresses created in a proximal end of a fan blade, where the proximal end is the end positioned closer to the mounting rod. A further object is to reduce support loading at the proximal end by providing support to the blade at a distal location. A still further object is to provide support for the blade at a distal location without subjecting the fan blade to significant torquing at the distal location.

Another object is to provide a fan blade having an increased angle-of-attack (or larger negative angle-of-attack, depending on the rotational direction of the fan blade). Another object is to provide this fan blade having the increased angle without substantially increasing the strength, and hence the weight, of the fan blade. A still further object is to provide a light-weight fan blade at an increased angle-of-attack.

Another object is to reduce fan blade breakage while still positioning a fan blade at an increased angle-of-attack.

Another object is to provide a light-weight fan blade at an increased angle-of-attack where the blade is reinforced, or additionally supported, from only the top or the bottom side. Although, dual-sided support is appropriate for some applications. A further object is to provide such a light-weight fan blade that is capable of being subjected to forces created by frequently rotating the fan in two directions, i.e., forward and reverse (or winter and summer) without increasing the tendency for blade to break. A still further objective is to provide support to this light-weight fan blade with a relatively light-weight structure that is relatively inflexible in axial motion and semi-flexible in bending motion. An objective, for some applications, is to orient the lightweight structure relative to the fan blade such that the relatively inflexible axis resists bending of the fan blade about an axis perpendicular to an axis extending radially along the length of the blade.

Another object is to distribute fan-hub loading, due to, e.g., wind resistance on fan blades and fan blade weight, over a larger surface area, i.e., provide a larger support base for each fan blade. A further object is to increase this support base without significantly altering a conventional fan blade shape.

Yet another object is to provide a simple to assemble fan kit that forms a high-profile fan blade, i.e., a fan blade having a relatively large angle-of-attack (or pitch) relative to its direction of rotation. A further object is to easily attach this high-profile fan blade to a rotatable hub. Another object is to create a high profile fan blade assembly that is easily attachable to the rotatable hubs whereby the fan blade is easily attachable to the hub.

Other objects and advantages of the invention will be apparent to those of skill in the art.

SUMMARY OF THE INVENTION

In accordance with the invention, a room fan may comprise a mounting rod and a hub. The hub typically includes a rotatable hub rotatably mounted on the mounting rod. At least one fan blade extends radially from the rotatable hub. A proximal end of the fan blade is positioned proximate to the mounting rod and a distal end of the fan blade is radially spaced from the proximal end. The fan comprises a brace that includes a proximal end positioned proximate the mounting rod and radially fixed relative to the mounting rod. The brace proximal end may, for example, be fixed to the rotatable hub. A distal end of the brace is radially spaced from the proximal end of the brace and connected to the fan blade. The distal end of the brace may, for example, be connected in the middle portion of the fan blade, measured along its length. The brace may, for example, contact the fan blade at only one point while the proximal end of the brace is connected to the rotatable hub. For some applications, the brace is connected to the rotatable hub at a plurality of locations, e.g., spaced about a circumference of the rotatable hub.

Where the proximal end of the fan blade is connected to the rotatable hub, the proximal end of the brace may be connected to the rotatable hub at a location axially spaced from the proximal end of the fan blade. The fan blade support base may be enlarged by, for example, spacing the proximal end of the brace further from the proximal end of the fan blade, where both proximal ends are connected to the rotatable hub. The support base may also be enlarged by enlarging the space or spaces between the locations at which the brace proximal end is connected to the hub. In some applications, the brace proximal-end connections are generally spaced out along a line generally perpendicular to a line between the brace proximal end and the fan blade proximal end.

For some applications, the fan blade is attached to a fan blade attachment which is in turn attached to the rotatable hub. When a plurality of fan blades are to be attached, it is often desirable to form the fan blade attachment from a plurality of segments spaced equidistantly, i.e., separated by equal angles, at a common radius, about the rotatable hub. In some embodiments a segment comprises a bracket including a slot to receive the proximal end of the fan blade. The brace may then be connected between a mid-section of the fan blade and the bracket.

The brace may comprise a plurality of members. In some applications, the members may be spokes and the spokes may, or may not, be connected together at one end. To reduce localized torquing of the fan blade at the location where the brace connects to the fan blade, a pivotal connection between the fan blade and the brace may be used. The distal end of the brace may, for example, be fixed in a brace mount that is pivotally mounted to the fan blade. The ability of the brace mount to pivot relative to the fan blade may be controlled by tightening the connection to increase pressure against the fan blade by the brace mount.

In some applications, it is desirable to form a fan blade assembly and then connect the assembly to the rotatable hub. Accordingly, embodiments of the invention are directed toward fan and fan blade kits.

Similarly, aspects of the invention are directed to methods of operating fans and assembling fans, and the like.

Other aspects of the present invention will become apparent to those skilled in the art upon studying this disclosure.

DETAILED DESCRIPTION OF THE ILLUSTRATED EMBODIMENT

Figure 1:
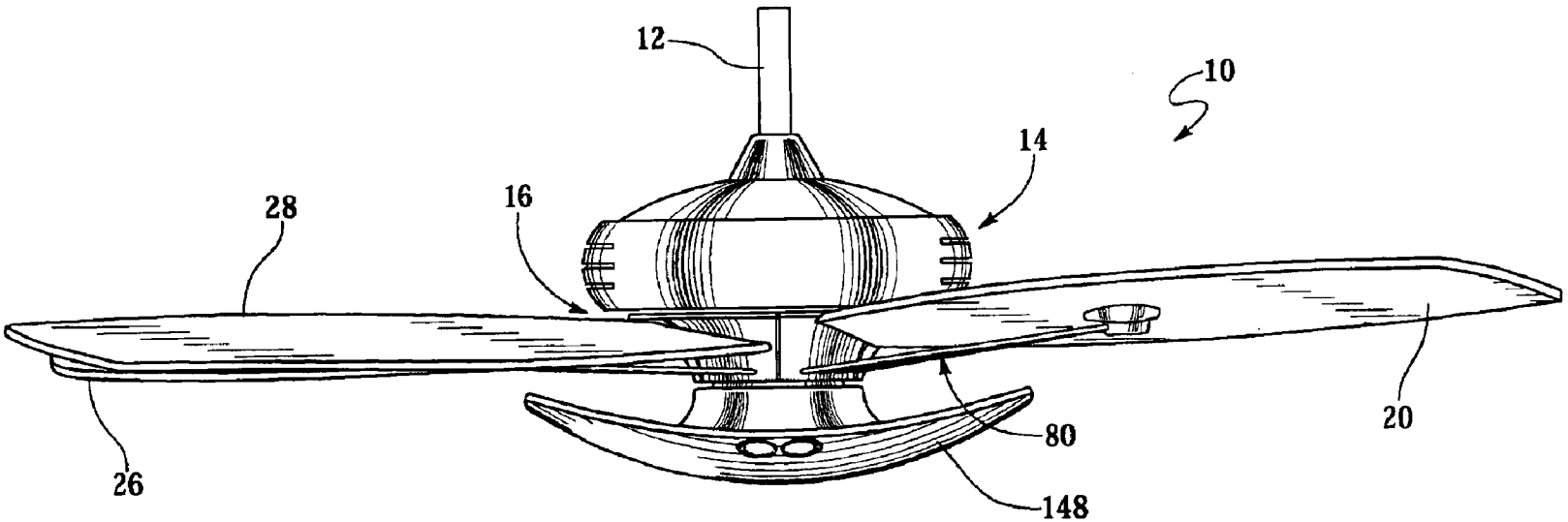
FIG. 1 shows a side elevation view of a ceiling fan.

FIG. 1 depicts a side elevated view of a ceiling fan 10 suspended from the ceiling with a downrod assembly that includes a mounting rod 12. The ceiling fan 10 comprises a hub 14, that includes a rotatable hub 16 rotatably mounted on the mounting rod 12. A plurality of fan blades 20, 22, 24, 26 and 28 are spaced equidistantly about the rotatable hub 16 and extend radially from the rotatable hub 16. For clarity, similar fan items respectively associated with multiple similar structures will generally only be described with respect to one of the similar structures, rather than identify each item associated with each structure. Accordingly, each fan blade 20 comprises a corresponding proximal end 30 and a corresponding distal end 40. And, with reference to FIG. 6, each fan blade 20 comprises a mid-section 50. For some applications the mid-section 50 spans half of the blade from the first quarter to the third quarter of the fan blade between the proximal and distal ends 30 and 40, i.e., there is approximately a quarter of the blade length at each end. A fan blade attachment 60 connects the proximal end 30 of the fan blade 20 to the rotatable hub 16.

Referring to FIGS. 2–7, for some applications the fan blade attachment 60 is formed from a plurality of brackets (70, 72, 74, 76 and 78) where each bracket corresponds to one of the fan blades (20–28). A brace 80 connects the mid-section 50 of the fan blade 20 to the bracket 70. The brace 80 does not need to be positioned at the mid-section 50 of the fan blade 20 but may be positioned at alternate locations, e.g., the distal end 40 of the fan blade 20, depending on the particular application. For some applications, the brace 80 is connected to the fan blade 20 near a mid-point 51 of the fan blade 20, e.g., within one width-length of the mid-point 51.

Figure 6:
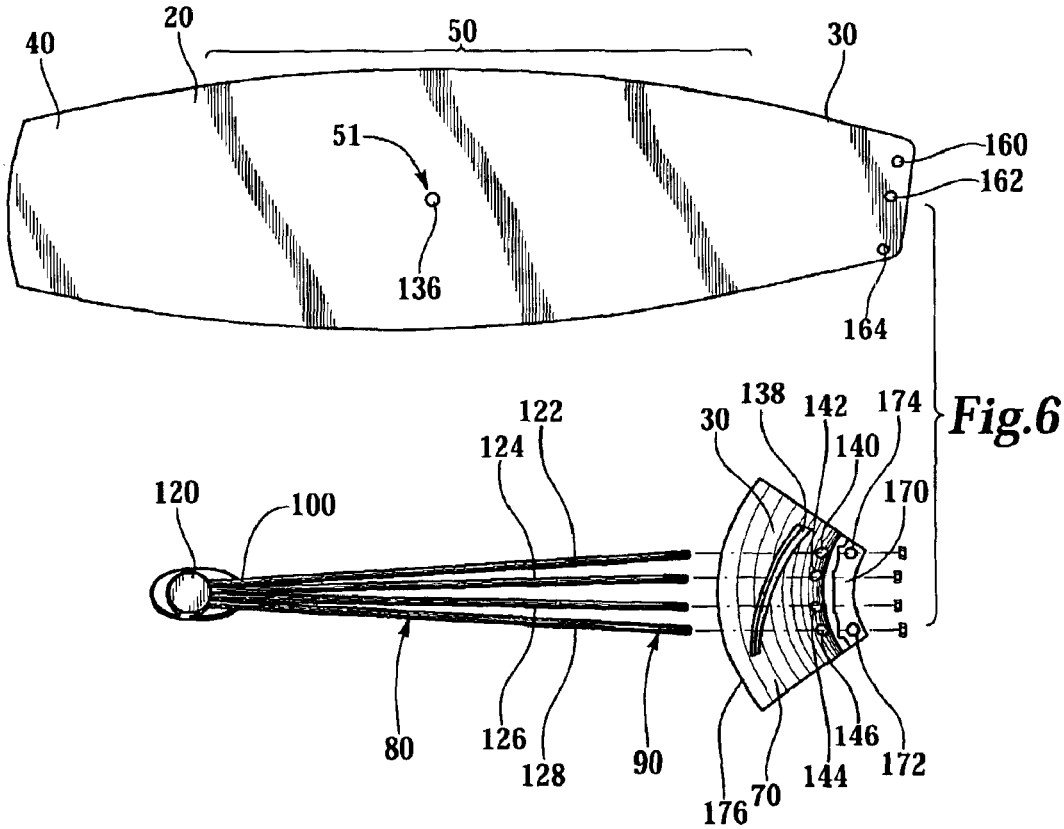
FIG. 6 shows a fan blade kit for forming the assembly shown in FIG. 4.
Figure 7:
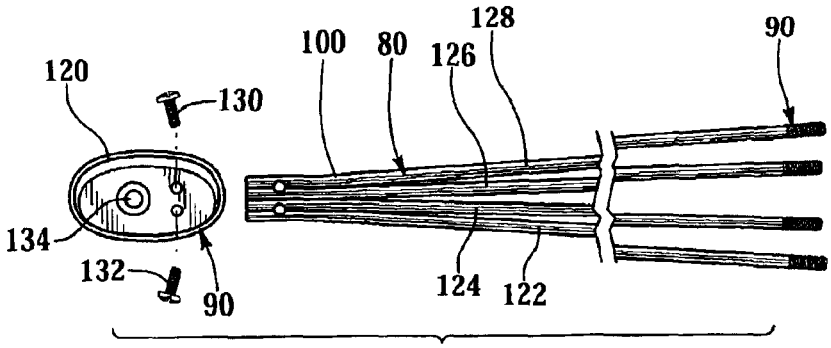
FIG. 7 shows a brace mount for connecting a plurality of spokes to the fan blade shown in FIG. 6.

Each brace 80 comprises a proximal end 90 attached to the corresponding bracket 70 and spaced axially, along an axis parallel to the mounting rod 12, from the corresponding fan blade proximal end 30. With reference to FIGS. 6 and 7, each brace 80 also comprises a distal end 100 which may be connected to the corresponding fan blade 20 via a brace mount 120. In some applications the brace 80 comprises a plurality of semi-flexible spokes (122, 124, 126, and 128). The semi-flexible spokes (122–128) may be connected together at the distal end 100 of the brace 80, such as by welding. The distal end 100 of the brace 80 may be rigidly positioned in the brace mount 120 by brace 15 mount screws 130 and 132. The brace mount 120 may comprise a pin 134 adapted to couple with a fan blade port 136 to pivotally connect the brace 80 to the fan blade 20.

Figure 4A:
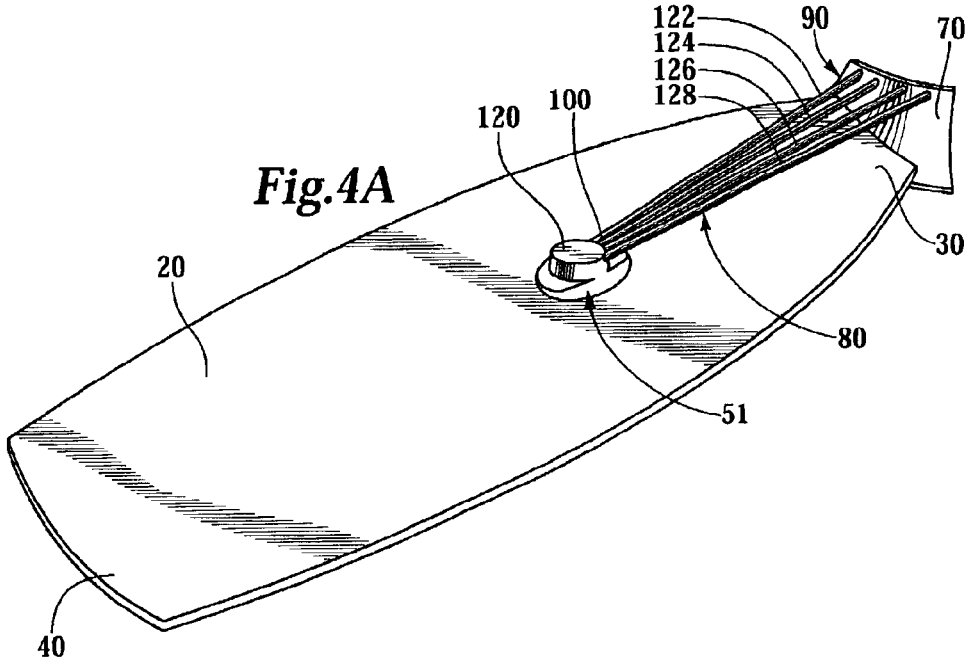
FIGS. 4A–4C show a fan blade assembly ready for mounting.
Figure 4B:
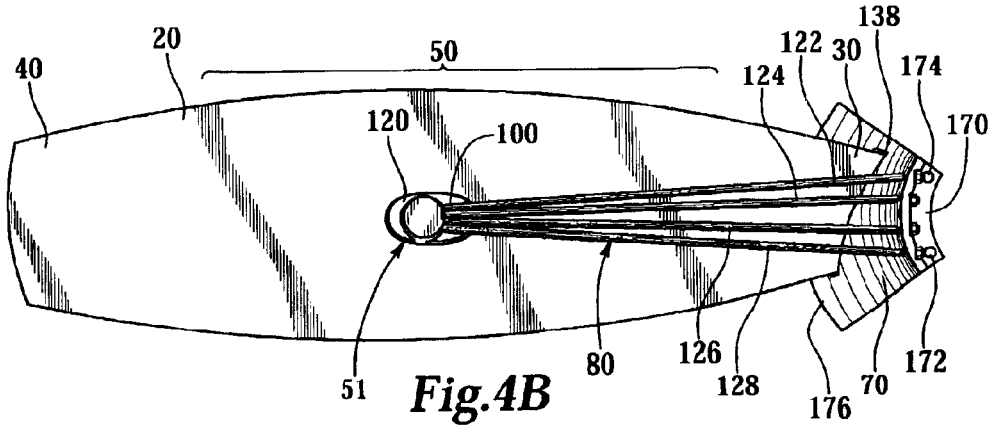
Figure 4C:
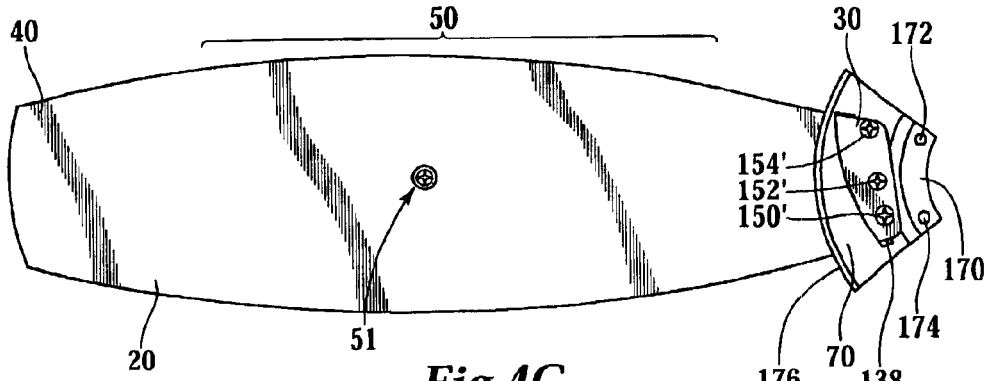
Figure 5A:
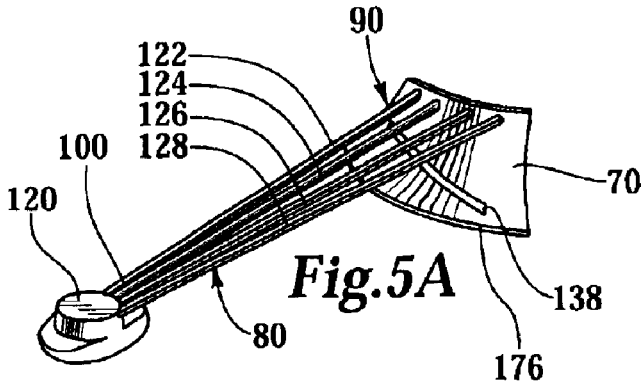
FIGS. 5A–5C show the brace of FIGS. 4A–4C connected to a bracket.
Figure 5B:
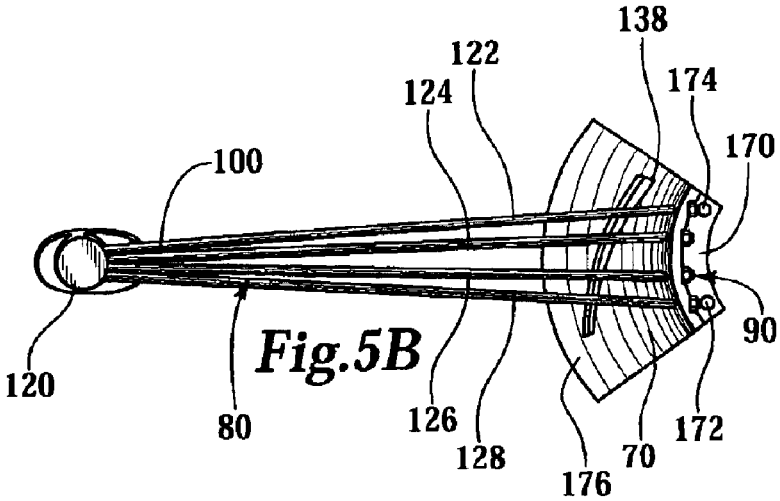
Figure 5C:
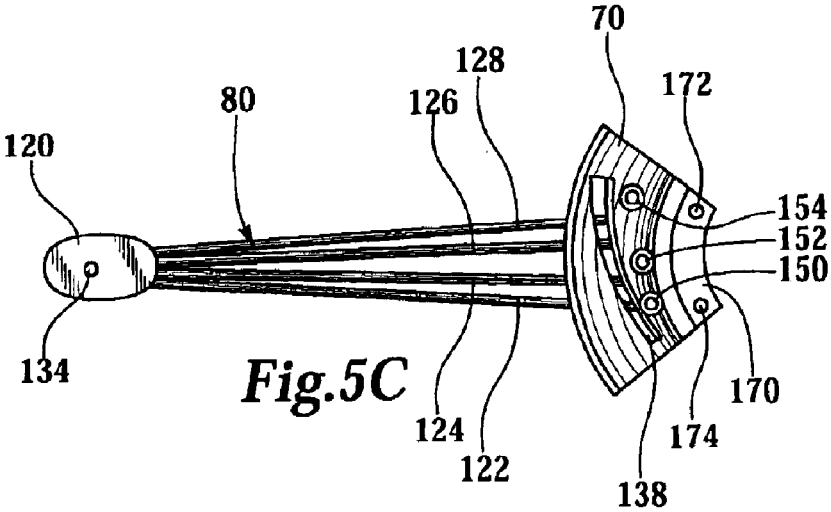

With reference to FIGS. 4–6, each bracket comprises a slot 138 and a plurality spoke attachments 140, 142, 144 and 146. The proximal end 30 of the fan blade is positioned in the slot 138 of the corresponding bracket 70.

A fan blade retainer may be used to further secure the fan blade 20 in the bracket 70. In the illustrated embodiment, the fan blade retainer comprises receptacles 150, 152 and 154 in the bracket 70 (see FIG. 5C) as well as screws 150', 152' and 154' (see FIG. 4C) passing through ports 160, 162 and 164 (see FIG. 6) in the proximal end 30 of the fan blade 20.

In embodiments where the bracket 70 is not integral with the rotatable hub 16, a bracket retainer may be used to couple the bracket 70 to the rotatable hub 16. In the illustrated embodiment, the bracket retainer comprises a flange 170 integral with the bracket 70. And the illustrated flange 170 comprises ports 172 and 174 for connecting screws to the rotatable hub 16. The flange 170 and the rotatable hub 16 are shaped to cooperatively mate. The flange 170 may include an edge 176 that fits under a lip (not shown) of the rotatable hub 16 to further secure the bracket 70 in position.

Figure 2:
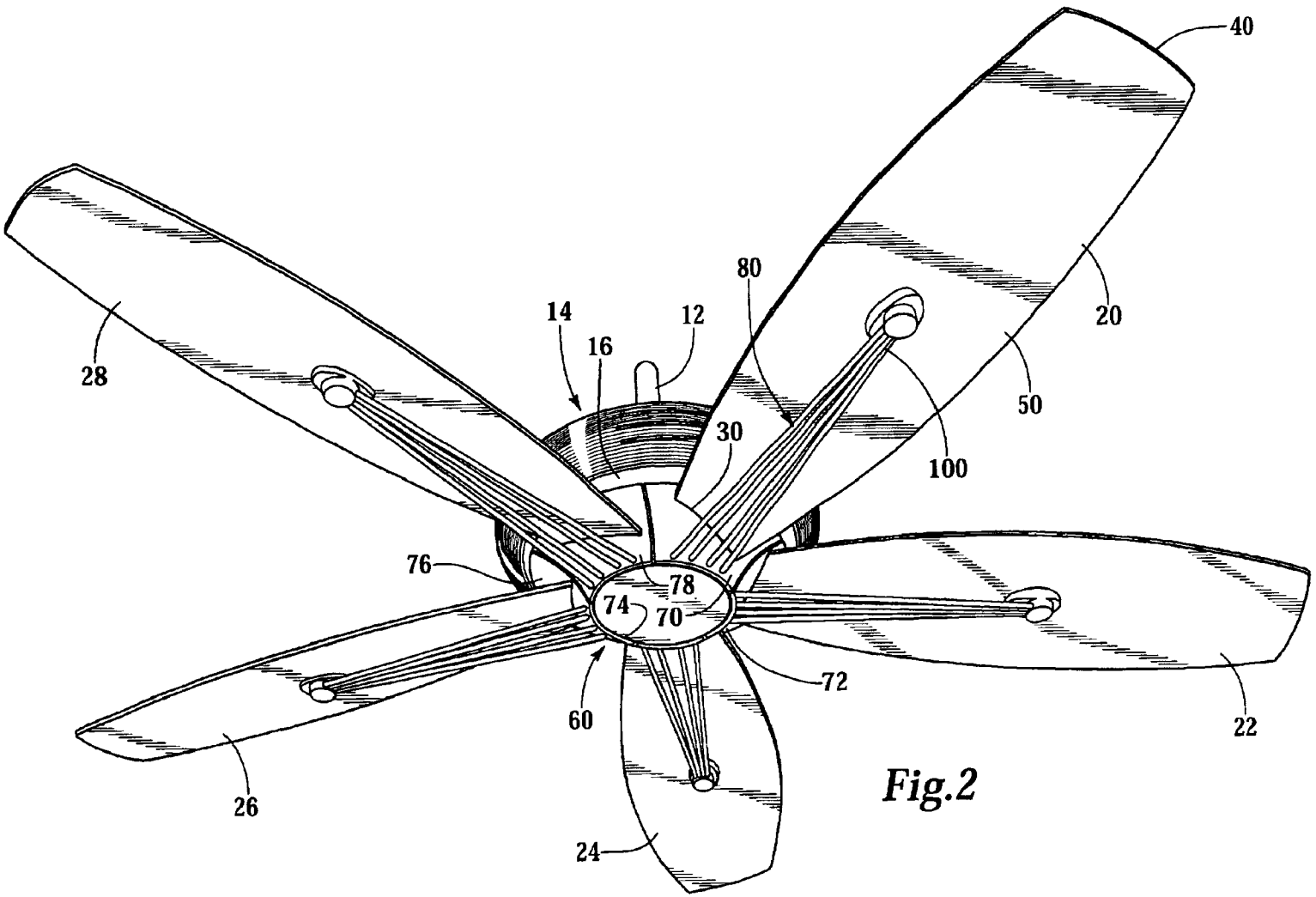
FIG. 2 shows a bottom perspective view of the ceiling fan shown in FIG. 1., wherein a plurality of fan blades are equidistantly spaced about a hub and radially extending therefrom.
Figure 3:
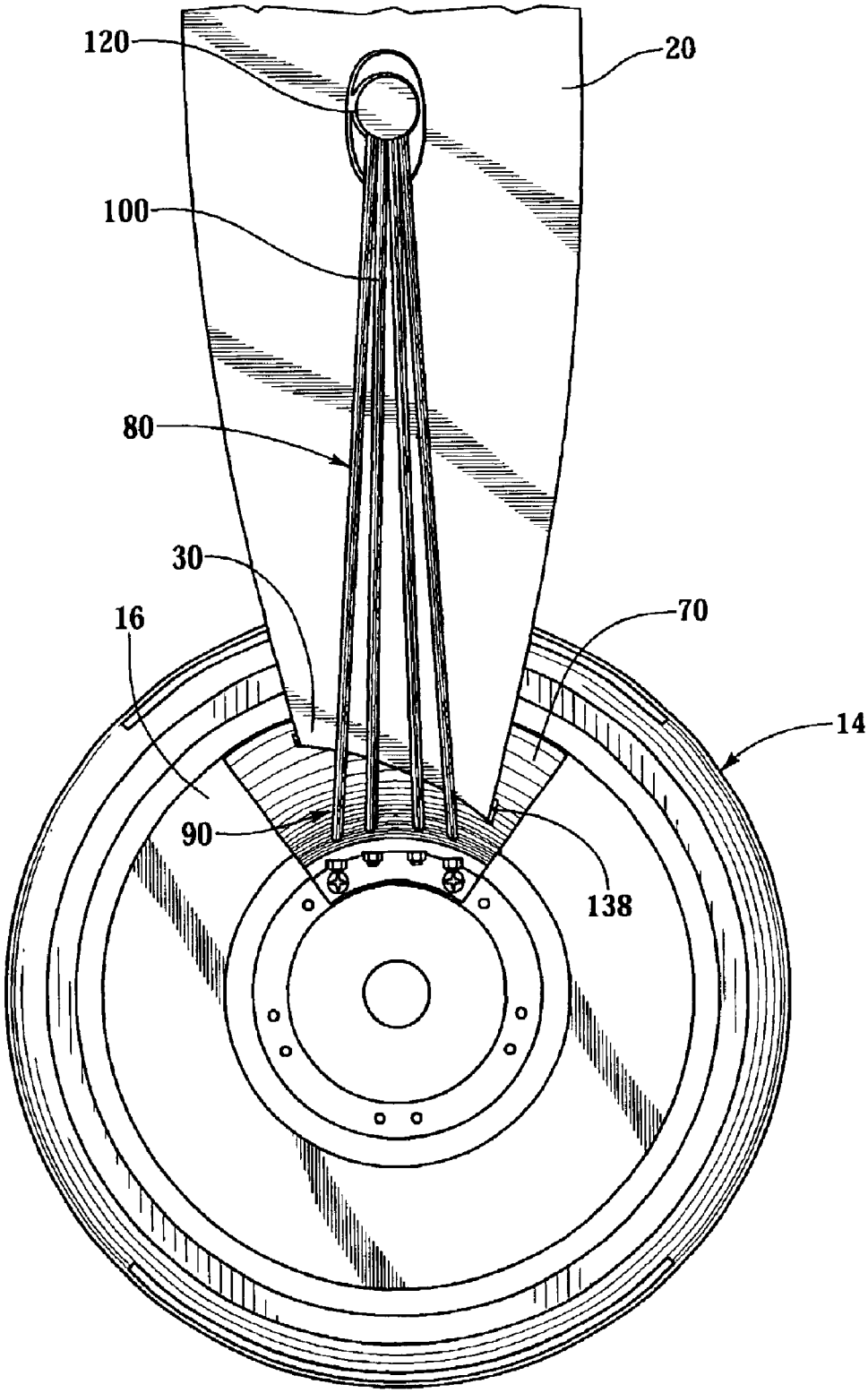
FIG. 3 shows one fan blade mounted to the rotatable hub.

With reference to FIGS. 1–2, the invention, while generally directed to room fans, has particular advantages when embodied in a ceiling fan. In ceiling fan applications, in particular, as well as other applications generally, a light 148 may be suspended below the rotatable hub 16. The light 148 may be stationarily or rotatably mounted relative to the mounting rod 12.

Use of directional terms such as above, below, before, after and the like are used for convenience and clarity to describe concepts relative to the embodiments illustrated. Use of such terms is not intended to convey an absolute orientation or position of a particular component in space for all applications and embodiments of the concepts.

Some embodiments are directed toward a fan blade kit that is adapted for use with a rotatable hub 16 of a room fan. With reference to FIG. 6, such a fan blade kit may comprise a fan blade 20 and a bracket 70 adapted to attach to the rotatable hub 16. The bracket 70 comprises a slot 138 adapted to receive the fan blade 20. A brace 80, which comprises a proximal end 90 and a distal end 100, may be formed from a plurality of semi-flexible spokes 122–128. To increase stability of the brace 80, the distal end 100 of the brace 80 is connected together, i.e., the spokes are connected together at the distal end 100, and rigidly secured via brace mount screws 130 and 132 to the brace mount 120.

An aspect of the invention is directed toward a method of assembling a ceiling fan. In one embodiment, the method comprises connecting a distal end 100 of a brace 80 to a fan blade 20 and attaching a proximal end 90 of the brace 80 to a bracket 70. The fan blade proximal end 30 is maintained in the bracket 70, which separates the fan blade proximal end 30 from the proximal end 90 of the brace 80. Fixing the fan blade proximal end 30 in spaced-apart relation to the brace proximal end 90 increases the support base of the fan blade, as compared to that of a conventional ceiling fan blade supported as a cantilever. After the fan blade 20 is correctly positioned, the bracket 70 is attached to the rotatable hub 16.

Using the bracket 70 and the brace 80 to support the fan blade allows the fan blade to be subjected to greater forces due to wind resistance without increasing the likelihood the blade will break. Moving the brace mount point 136 more distally reduces reactive moments felt at the proximal end 30 of the fan blade 20. Similarly, spacing out the connection locations on the hub 14 for the spokes increases the support base of the fan blade 20.

While the present invention has been described with reference to one or more particular embodiments, those skilled in the art will recognize that many changes may be made thereto without departing from the spirit and scope of the present invention. Each of these embodiments, and obvious variations thereof, is contemplated as falling within the spirit and scope of the claimed invention, which is set forth in the following claims.

What is claimed is:

1. A room fan comprising:

a mounting rod;

a hub comprising a rotatable hub rotatably mounted on the mounting rod;

a fan blade extending radially from the rotatable hub and comprising a proximal end proximate to the mounting rod and a distal end radially spaced from the proximal end; and a brace comprising:

a proximal end positioned proximate the mounting rod and radially fixed relative to the mounting rod;

a distal end radially spaced from the proximal end of the brace and connected to the fan blade at one or more locations radially spaced from the proximal end of the fan, wherein the proximal end of the brace is spaced from the proximal end of the fan blade and is below the proximal end of the fan blade, and further wherein the brace comprises a plurality of members and the proximal end of the brace is connected to the rotatable hub at a corresponding plurality of locations.

2. The fan of claim 1, wherein the brace is separated from the fan blade between the brace proximal end and the brace distal end.

3. The fan of claim 1, wherein the brace proximal end is spaced axially, along an axis parallel to the mounting rod, from the fan blade proximal end.

4. The fan of claim 1, comprising a fan blade attachment attached to the rotatable hub, wherein the fan blade proximal end is attached to the fan blade attachment and the brace proximal end is attached to the fan blade attachment.

5. The fan of claim 4, wherein the brace proximal end is spaced axially, along an axis parallel to the mounting rod, relative to the fan blade proximal end.

6. The fan of claim 4, wherein the fan blade attachment comprises a slot and the fan blade proximal end is positioned in the slot.

7. The fan of claim 1, wherein the plurality of members are connected together at the distal end of the brace.

8. The fan of claim 7, comprising a brace mount rigidly connected to the distal end of the brace and pivotally connected to the fan blade.

9. The fan of claim 1, wherein the fan blade comprises a mid-section midway between the fan proximal and distal ends and the brace distal end is connected to the fan blade mid-section.

10. A room fan comprising:

a mounting rod;

a hub comprising:

a rotatable hub rotatably mounted on the mounting rod;

a fan blade attachment rigidly attached to the rotatable hub;

a plurality of fan blades respectively comprising:

a proximal end attached to the fan blade attachment;

a distal end radially spaced from the proximal end; and a mid-section midway between the proximal end and the distal end; and a plurality of braces corresponding to the plurality of fan blades and respectively comprising:

a proximal end attached to the fan blade attachment and spaced from the proximal end of the fan blade; and a distal end attached to the mid-section of the fan blade.

11. The fan of claim 10, comprising a light mounted below a rotatable housing.

12. The fan of claim 10, wherein the fan blade attachment comprises a plurality of brackets corresponding to the plurality of fan blades and wherein the brackets are removably attached to the rotatable hub.

13. The fan of claim 10, wherein the fan blade attachment comprises a plurality of slots corresponding to the plurality of fan blades, wherein the proximal end of each fan blade is positioned in the corresponding slot.

14. The fan of claim 13, wherein each brace comprises a plurality of members connected together at the distal end of the brace and spaced apart at the proximal end of the brace.

15. The fan of claim 14, comprising a plurality of brace mounts corresponding to the plurality of fan blades, wherein each brace mount is rigidly connected to the plurality of members of the corresponding brace and pivotally connected to the corresponding fan blade.

16. The fan of claim 14, wherein each of the members of the braces is a semi-flexible spoke.

17. The fan of claim 10, comprising a plurality of brace mounts corresponding to the plurality of braces, wherein each brace mount connects the distal end of the corresponding brace to the corresponding fan blade.

18. The fan of claim 17, wherein each brace comprises a plurality of semi-flexible spokes connected together in the corresponding brace mount and attached, in spaced-apart relation, to the fan blade attachment.

19. A fan blade kit adapted for use with a rotatable hub of a room fan, the kit comprising:

a fan blade;

a bracket adapted to attach to the rotatable hub and comprising a slot adapted to receive the fan blade;

a brace comprising a proximal end adapted to attach to the bracket and a distal end;

a brace mount adapted to connect the distal end of the brace to the fan blade, wherein the fan blade is adapted to connect with the brace mount.

20. A room fan comprising:

a mounting rod;

a rotatable hub rotatably mounted on the rod;

a plurality of brackets removably attached to the rotatable hub and spaced equidistantally about the rotatable hub, wherein each bracket comprises a slot;

a plurality of fan blades corresponding to the plurality of brackets, wherein each fan blade comprises a proximal end positioned in the slot of the corresponding bracket, a distal end radially spaced from the proximal end and a mid-section therebetween; and a plurality of braces corresponding to the plurality of fan blades, wherein each brace comprises:

a proximal end attached to the corresponding bracket and spaced apart from the proximal end of the corresponding fan blade; and a distal end connected to the mid-section of the corresponding fan blade.

21. The fan of claim 20, comprising a plurality of brace mounts corresponding to the plurality of braces, wherein each brace mount is rigidly connected to the distal end of the corresponding brace and pivotally connected to the mid-section of the corresponding fan blade.

22. The fan of claim 20, wherein each brace comprises a plurality of semi-flexible spokes connecting the corresponding bracket to the mid-section of the corresponding fan blade, wherein the semi-flexible spokes are spaced apart at the proximal end of the brace.

23. A method of assembling a ceiling fan, the method comprising:

connecting a proximal end of a fan blade to a bracket, wherein the proximal end of the fan blade is intended to be closer to a mounting rod of the ceiling fan than a distal end of the fan blade;

connecting a distal end of a brace to the fan blade;

attaching a proximal end of the brace to the bracket;

maintaining the proximal end of the fan blade in the bracket while allowing the bracket to maintain the proximal end of the fan blade apart from the proximal end of the brace;

positioning the fan blade relative to the mounting rod such that the proximal end of the brace is closer to the mounting rod than the distal end of the brace;

attaching the bracket to a rotatable hub of the ceiling fan; and allowing the bracket and brace to support the fan blade.

24. The method of claim 23, comprising positioning the fan blade, bracket and brace such that the proximal end of the brace is below the proximal end of the fan blade when the bracket is attached to the rotatable hub and the rotatable hub is suspended from a ceiling.

25. A method of assembling a fan, the method comprising:

connecting a proximal end of a fan blade to a rotatable hub;

placing a proximal end of a brace in spaced-apart relation to the proximal end of the fan blade, such that the proximal end of the fan blade is higher than the proximal end of the brace when the fan is in operation;

connecting a distal end of the brace to the fan blade, wherein the distal end of the brace is positioned further from a mounting rod than the proximal end of the brace when the fan is in operation;

fixing the fan blade relative to the brace, wherein the fan blade and the brace rotate with the rotatable hub; and attaching the proximal end of the brace to a bracket and attaching the bracket to the rotatable hub.

* * * * *